US007271331B2

(12) United States Patent
Lindemann

(10) Patent No.: US 7,271,331 B2
(45) Date of Patent: Sep. 18, 2007

(54) MUSICAL SYNTHESIZER WITH EXPRESSIVE PORTAMENTO BASED ON PITCH WHEEL CONTROL

(76) Inventor: Eric Lindemann, 2975 18th St., Boulder, CO (US) 80304

( * ) Notice: Subject to any disclaimer, the term of this patent is extended or adjusted under 35 U.S.C. 154(b) by 0 days.

(21) Appl. No.: 11/342,781

(22) Filed: Jan. 30, 2006

(65) Prior Publication Data

US 2007/0175319 A1 Aug. 2, 2007

(51) Int. Cl.
*G10H 1/02* (2006.01)
*G10H 7/00* (2006.01)

(52) U.S. Cl. ..... 84/628

(58) Field of Classification Search ..... 84/626, 84/628, 662, 701, 704, 737
See application file for complete search history.

(56) References Cited

U.S. PATENT DOCUMENTS 3,626,350 A * 12/1971 Suzuki et al. ..... 338/69
4,813,327 A * 3/1989 Abe ..... 84/634
5,401,898 A * 3/1995 Usa et al. ..... 84/658
5,578,780 A * 11/1996 Wachi ..... 84/659
6,087,578 A * 7/2000 Kay ..... 84/626
RE37,654 E * 4/2002 Longo ..... 84/626
6,452,082 B1 * 9/2002 Suzuki et al. ..... 84/609
6,459,028 B2 * 10/2002 Yamauchi ..... 84/477 R
6,816,833 B1 * 11/2004 Iwamoto et al. ..... 704/207
2003/0188627 A1 * 10/2003 Longo ..... 84/627

* cited by examiner

*Primary Examiner*—Lincoln Donovan
*Assistant Examiner*—Andrew Millikin
(74) *Attorney, Agent, or Firm*—Macheledt Bales & Heidmiller, LLP; Jennifer L. Bales

(57) ABSTRACT

The present invention is a musical synthesizer that can respond to a pitch wheel control by generating realistic slide-step-slide and slide-step portamento pitch curves. The musical synthesizer responds to a pitch wheel control in a context sensitive manner. When a first note-on occurs the pitch wheel behaves in the standard fashion. However, when a second-note on occurs, if the pitch wheel is still being held after the second note-on then the effects of the pitch wheel are disabled. The result is a clean slide-step portamento curve. In addition, the effects of the pitch wheel are delayed slightly relative to the raw pitch wheel signal. The result is that if the pitch wheel is released slightly before a second note-on occurs then the delayed pitch wheel signal will still be at substantially the previous held value when the second note-on occurs. The result is a clean slide-step portamento curve. In another embodiment when a second-note on occurs, if the pitch wheel is still being held after the second note-on, effects of the pitch wheel are disabled and, in addition, the pitch curve is forced to make a small ramp beginning towards the pitch of the second note-on. The result is a clean slide-step-slide portamento curve.

12 Claims, 14 Drawing Sheets

MUSICAL SYNTHESIZER WITH EXPRESSIVE PORTAMENTO BASED ON PITCH WHEEL CONTROL

BACKGROUND OF THE INVENTION

1. Field of the Invention

This invention relates to synthesizing an expressive portamento transition between musical tones and controlling this portamento transition by modifying the effect of a pitch wheel control signal. In particular, the present invention pertains to synthesizers capable of responding to a typical pitch wheel control by generating slide-step-slide and slide-step portamento pitch curves 2. Background Art An important part of the expressive control exercised by a wind or string player involves controlling precisely how pitch changes from note to note and, in particular, how pitch changes during the transition from one note to the next. For example, when a violinist plays two notes of different pitches in succession he may choose to change the pitch in an abrupt manner or he may slide from the first pitch to the second by sliding his finger along the fingerboard in a continuous manner. This is called portamento. If the violinist slides from note to note-on the same string without changing the bow then the portamento pitch curve is very smooth with no discernable discontinuity in pitch from the first pitch to the second as shown in FIG. 1 (Background Art).

However, the violinist may also change bow direction at some point during the slide, the violinist may change the finger that depresses the string during the slide, or the violinist may change which string is bowed during the slide. In these later cases there is typically a more complex pitch curve. FIG. 2 (Background Art) shows a graph of pitch against time during a violin portamento of this type where the pitch of the first note is C and the pitch of the second note is G. As can be seen, towards the end of the first note the pitch begins a gradual slide away from C and toward G. At the beginning of the second note the pitch steps abruptly to a value somewhat below G. Then the pitch slides finally reaching G. This shape consisting of slide-step-slide is typical of many violin portamentos. Controlling the rates and amounts of the slides, the size of the pitch step, and the character of the articulation when the pitch step occurs is central to expressive violin playing. Other string instruments—viola, cello, contrabass—behave similarly to the violin. Wind instruments may employ a similar expressive control over portamento but to a lesser extent.

Another portamento variant is shown in the complex pitch curve of FIG. 3 (Background Art). This is the same as FIG. 2 except that the final slide is omitted. Instead at the beginning of the second note the pitch jumps all the way to G. This is the slide-step pitch curve.

A typical electronic musical synthesizer such as a MIDI keyboard instrument includes a piano or organ-like keyboard and a pitch wheel control. The pitch wheel control has a center detent position. Using one hand a performer can displace the pitch wheel control in a continuous manner above or below the center detent position. If the performer releases the pitch wheel it automatically returns to the center detent position.

When a note is struck on the keyboard a musical tone begins. In the typical musical synthesizer, at any instant the exact pitch of the musical tone is related to the sum of the pitch indicated by the struck key on the keyboard—C, D, F# etc—and the position of the pitch wheel. The pitch wheel enables the performer to "bend" the pitch in a quasi-continuous manner above or below the pitch indicated by the struck key.

A typical music synthesizer may also include a separate portamento control. When two notes of different pitches are played on the keyboard in succession, the portamento control determines the shape of the pitch change. With portamento set to zero, when the second note is played the pitch changes abruptly to the pitch of the second note. With non-zero portamento values, when the second note is played the pitch begins a gradual slide from the first note pitch to the second note pitch. The exact non-zero portamento value determines the rate of change of the pitch during this slide.

Suppose the performer wants to generate a slide-step-slide portamento transition as described above using the standard pitch wheel. Further, suppose that the performer is playing in a reasonably legato fashion so that the first note-off occurs either after the second note, at the second note-on, or very shortly before the second note-on. If the first note-off is at or after the second note-on then the sound continues without interruption between the first and second notes. If the note-off occurs slightly before the second note-on we assume that the note takes a finite amount of time to die away—e.g. 0.05 seconds—so that again the sound is substantially continuous from the first to the second note.

The performer can effectively perform the initial pitch-slide that occurs at the end of the first note. However if the performer continues to hold the pitch wheel after the second note is struck the pitch jumps to the keyboard pitch plus the current value of the pitch wheel. If the performer quickly releases the pitch wheel after striking the second note an undesirable quick slide back to the target pitch occurs. This is shown in FIG. 4 (Prior Art) where the additional dotted line curve at the bottom of the graph shows the motion of the pitch wheel beginning at its initial zero value center detent position.

Alternatively, if the performer releases the pitch wheel just prior to striking the second note there is an equally undesirable bend back to the first pitch before jumping abruptly to the second pitch. This is shown in FIG. 5 (Prior Art). It is almost impossible to synchronize the pitch wheel motion with the note starts in a manner that avoids the above two problems. As a result it is nearly impossible to achieve the desired slide-step-slide or slide-step pitch curve using the standard pitch wheel.

The portamento-control also does not support the generation of slide-step-slide pitch curves. The pitch shapes are deficient in two ways: first, the pitch slide does not begin until the second note is played on the keyboard; second, the pitch slides continuously from the first note pitch to the second note pitch—there is no step. This is shown in FIG. 6 (Prior Art).

Both MIDI portamento control and standard MIDI pitch wheel curves have shortcomings. A need remains in the art for apparatus and methods for generating portamento transitions in synthesized music which better model portamento transitions in musical performances.

SUMMARY OF THE INVENTION

Accordingly, an object of the present invention is to provide for apparatus and methods for generating portamento transitions in synthesized music, which better model portamento transitions in musical performances. This is accomplished by providing a musical synthesizer that can respond to a typical pitch wheel control by generating slide-step-slide and slide-step portamento pitch curves such as those shown in FIG. 2 and FIG. 3.

The musical synthesizer according to the present invention responds to a pitch wheel control in a context sensitive manner.

In a first embodiment of the present invention, when a first note-on occurs the pitch wheel behaves in the standard fashion. However, when a second-note on occurs, if the pitch wheel is still being held after the second note-on then the effects of the pitch wheel are disabled. This is illustrated in FIG. 7. The result is a clean slide-step portamento curve rather then the portamento curve of FIG. 4.

In a second embodiment of the present invention the effects of the pitch wheel are delayed slightly relative to the original raw pitch wheel. The result is that if the pitch wheel is released slightly before a second note-on occurs then the delayed pitch wheel signal will still be at substantially the previous held value when the second note-on occurs. This is shown in FIG. 8. The result is a clean slide-step portamento curve rather then the unnatural and clunky portamento curve obtainable in conventional synthesizers as shown in FIG. 5.

As an alternative, the pitch delay device can hold the pitch wheel signal at a peak value until the pitch wheel has returned to near-zero.

In a third embodiment of the present invention when a second-note on occurs, if the pitch wheel is still being held after the second note-on, effects of the pitch wheel are disabled and, in addition, the pitch curve is forced to make a small ramp beginning towards the pitch of the second note-on. This is illustrated in FIG. 9. The result is a clean slide-step-slide portamento curve rather then the prior art portamento curve of FIG. 4.

In a fourth embodiment of the present invention, the pitch bend behaves as in the third embodiment described above when the pitch wheel direction is positive, but behaves as in the first embodiment described above when the pitch wheel direction is negative.

In a fifth embodiment of the present invention the effects of the first and second embodiments are combined. So that clean slide-step portamento curves are generated whether the pitch wheel is released before or after the second note-on.

In a sixth embodiment of the present invention the effects of the first and third embodiments are combined. So that clean slide-step portamento curves occur when the pitch wheel is released before the second note-on and slide-step-slide portamento curves occur when the pitch wheel is released after the second note-on.

In a seventh embodiment of the present invention the effects of the first and fourth embodiments are combined. So that clean slide-step portamento curves occur when the pitch wheel is released before the second note-on or when the pitch wheel direction is negative, and slide-step-slide portamento curves occur when the pitch wheel is released after the second note-on and the pitch wheel direction is positive.

BRIEF DESCRIPTION OF THE DRAWINGS

FIG. 4 (Prior Art) shows the results of attempting a portamento on a synthesizer while holding the pitch-wheel after the $2^{nd}$ note-on.

FIG. 5 (Prior Art) shows the results of attempting a portamento on a synthesizer while releasing the pitch-wheel prior to the $2^{nd}$ note-on.

DETAILED DESCRIPTION OF THE INVENTION

Below is a detailed description of a musical synthesizer according to the present invention corresponding to the seventh embodiment described above in the Summary of the Invention. It will be obvious to one skilled in the art of synthesizer design that this embodiment can be adapted to correspond to any of the embodiments one through six discussed in the Brief Summary of the Invention.

Figure 1:
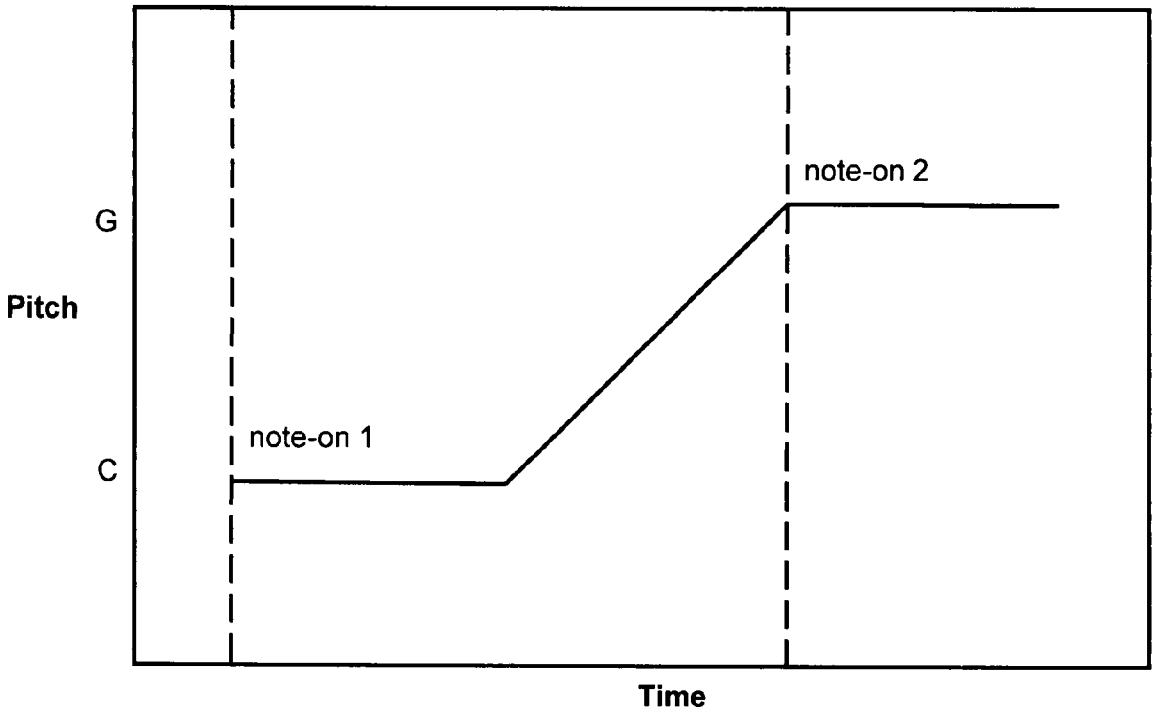
Figure 1 (Prior Art)
FIG. 1 (Background Art) shows a portamento with no pitch step.
Figure 2:
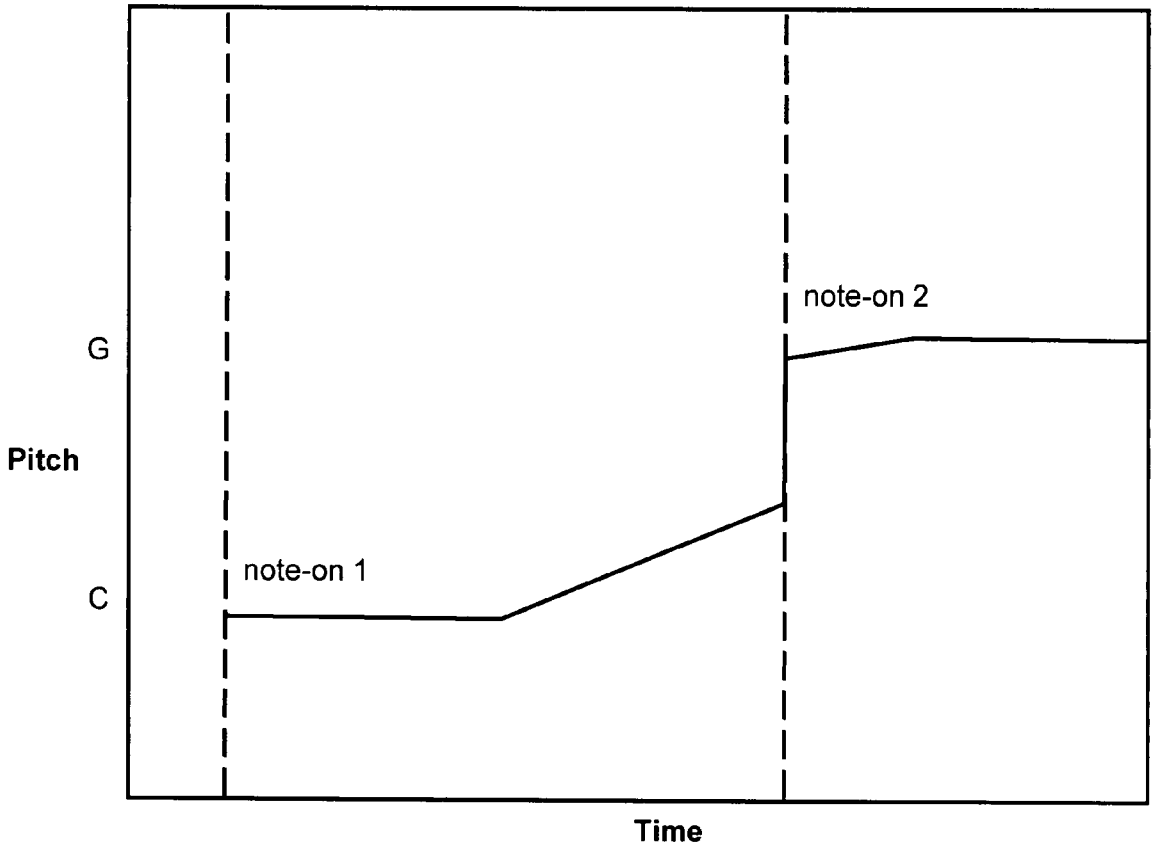
Figure 2 (Prior Art)
FIG. 2 (Background Art) shows a slide-step-slide portamento.
Figure 3:
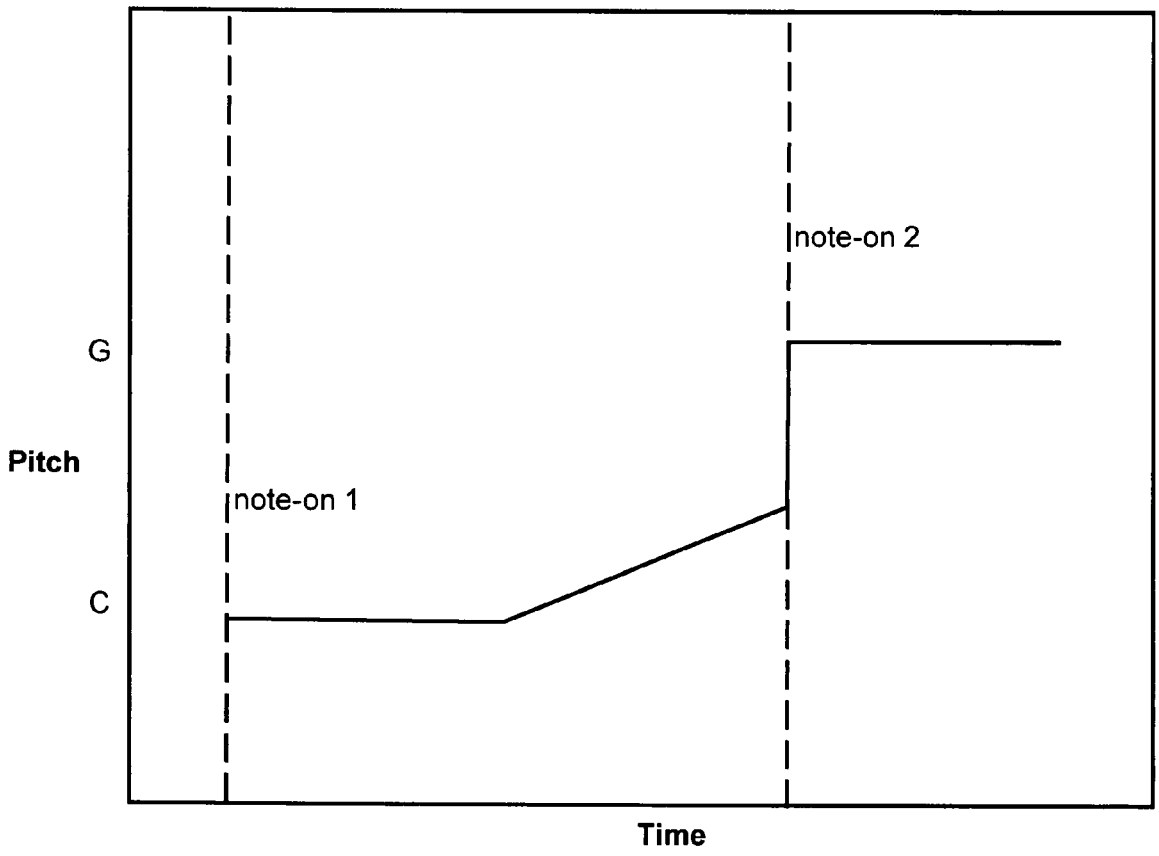
Figure 3 (Prior Art)
FIG. 3 (Background Art) shows a slide-step portamento.
Figure 4:
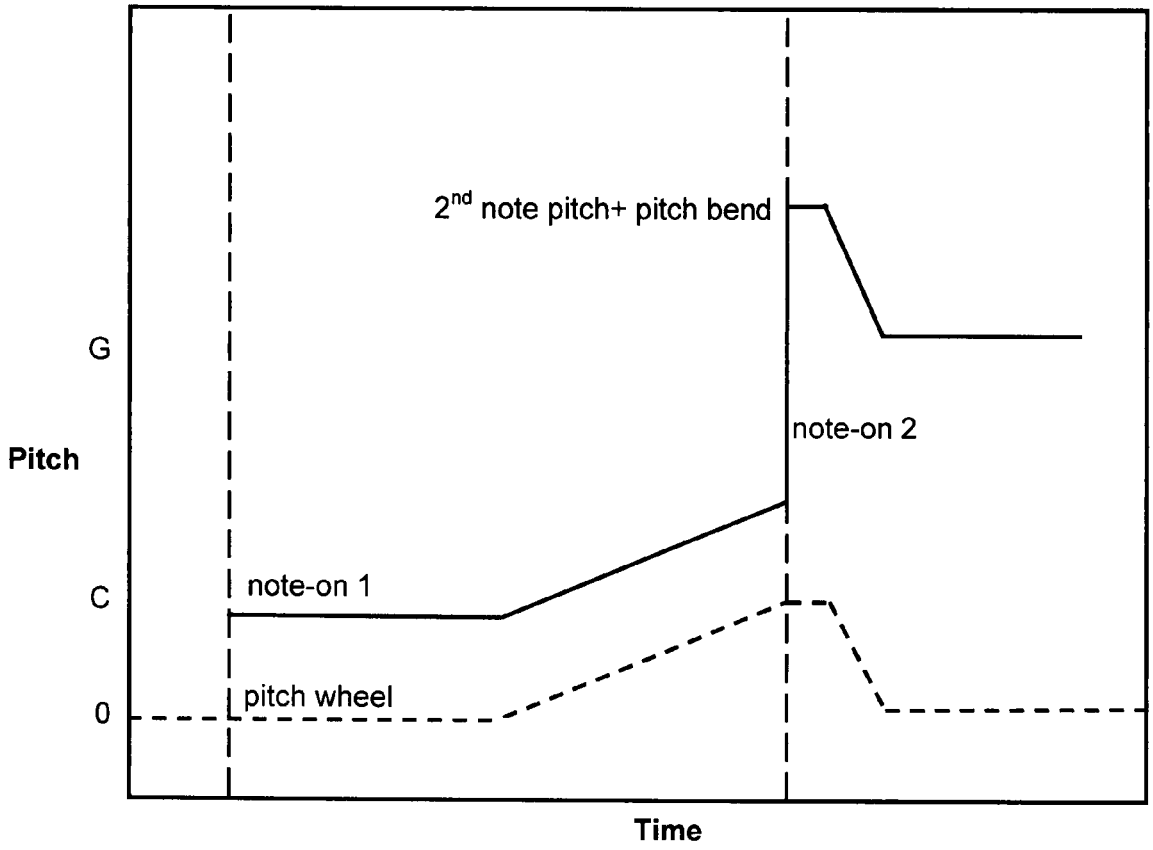
Figure 4 (Prior Art)
Figure 5:
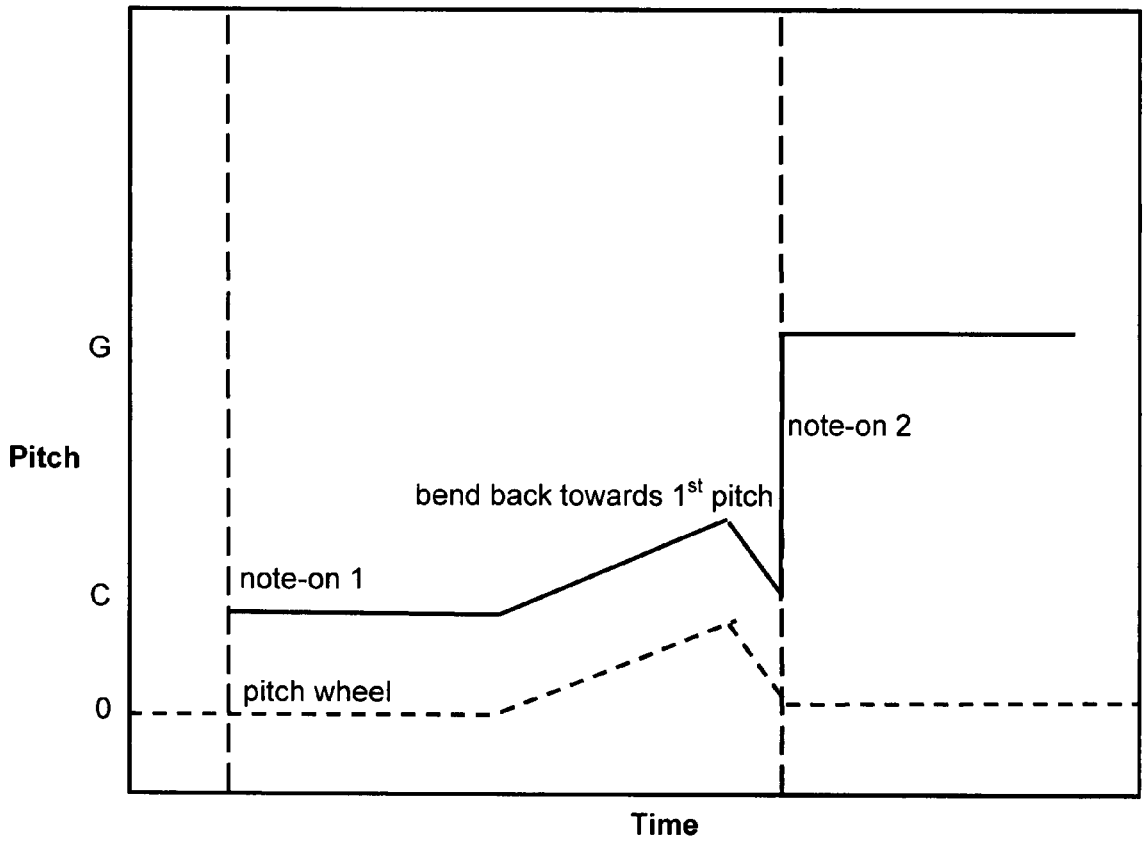
Figure 5 (Prior Art)
Figure 6:
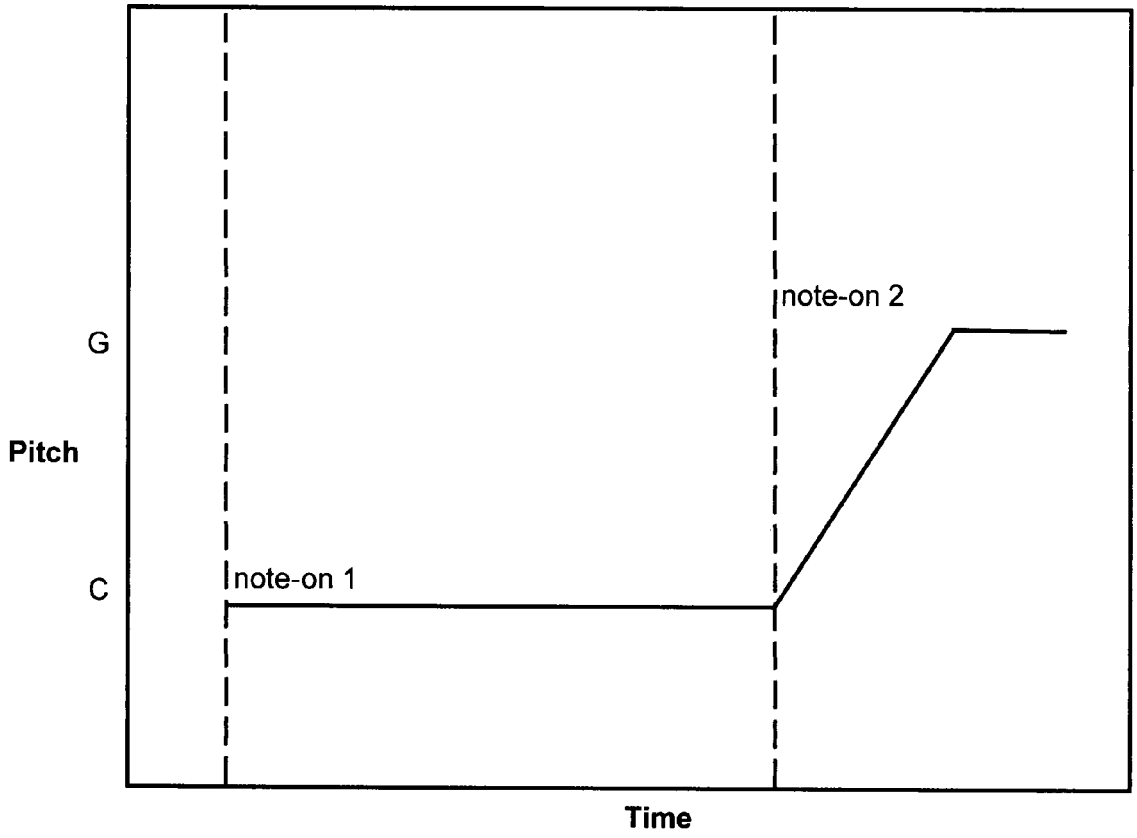
Figure 6 (Prior Art)
FIG. 6 (Prior Art) shows a portamento generated using the standard MIDI portamento control.
Figure 7:
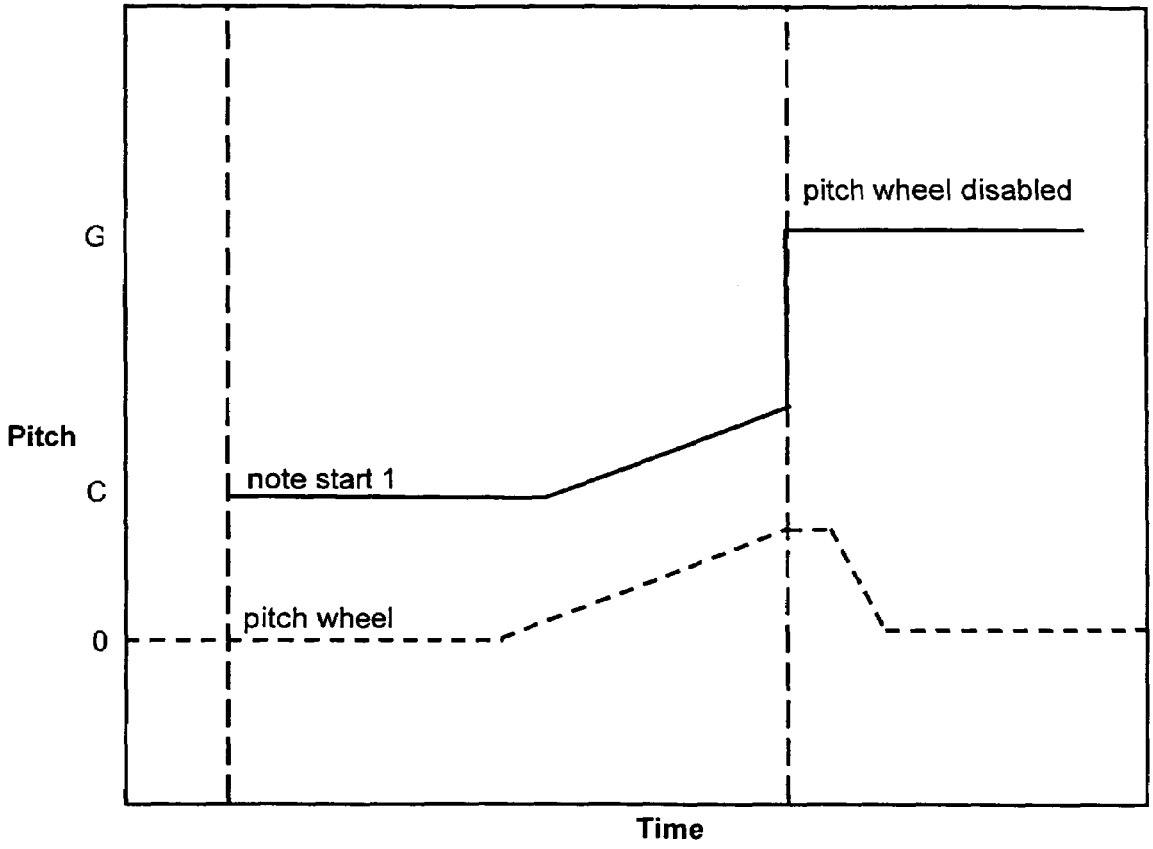
FIG. 7 shows the effect of disabling the pitch-wheel on a $2^{nd}$ note-on in accordance with a first embodiment of the present invention.
Figure 8:
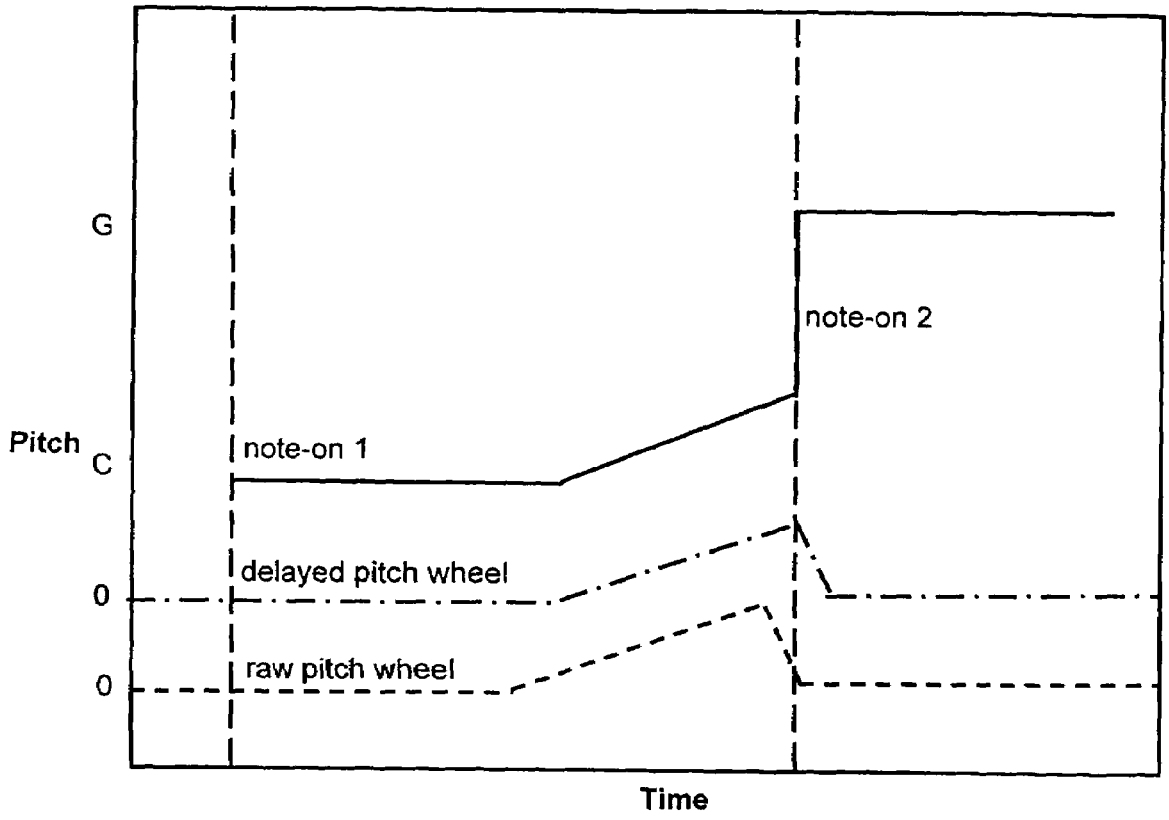
FIG. 8 shows the effect of delaying the pitch-wheel signal in accordance with a second embodiment of the present invention.
Figure 9:
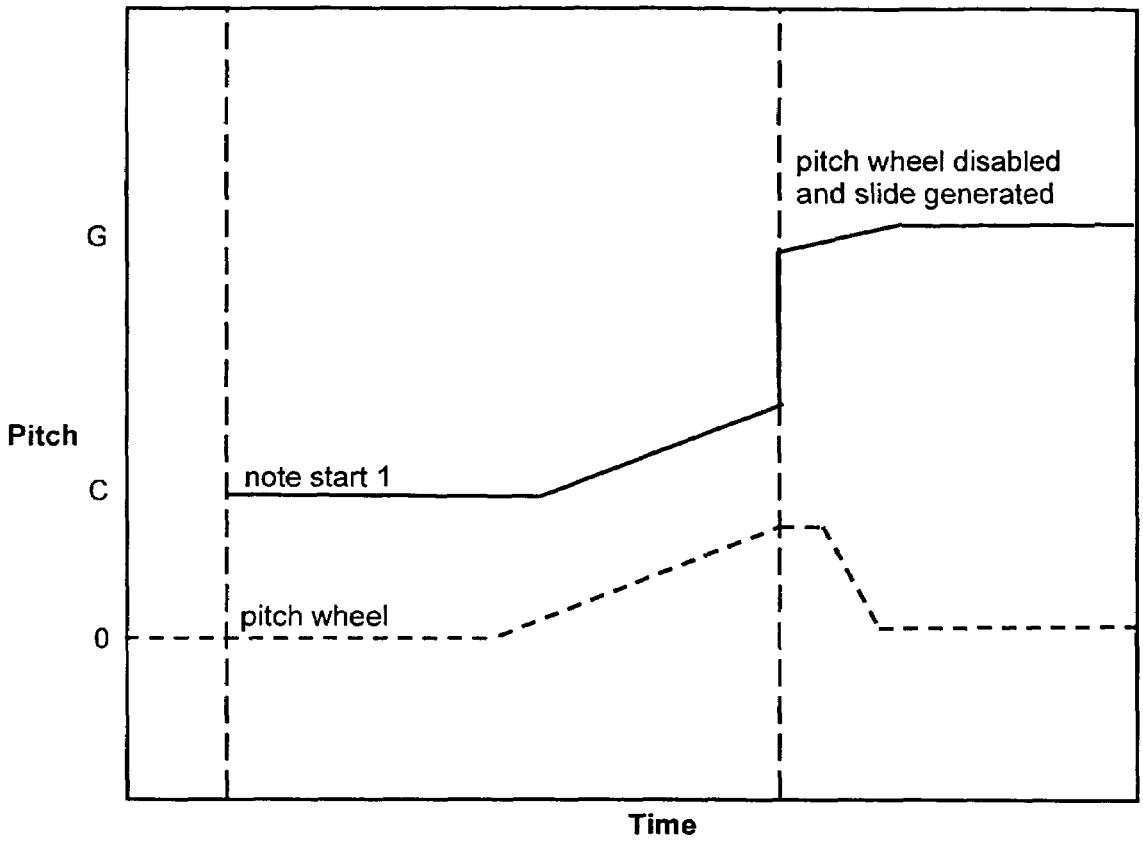
FIG. 9 shows the effect of delaying the pitch-wheel signal and forcing a slide on $2^{nd}$ note-on in accordance with a third embodiment of the present invention.
Figure 10:
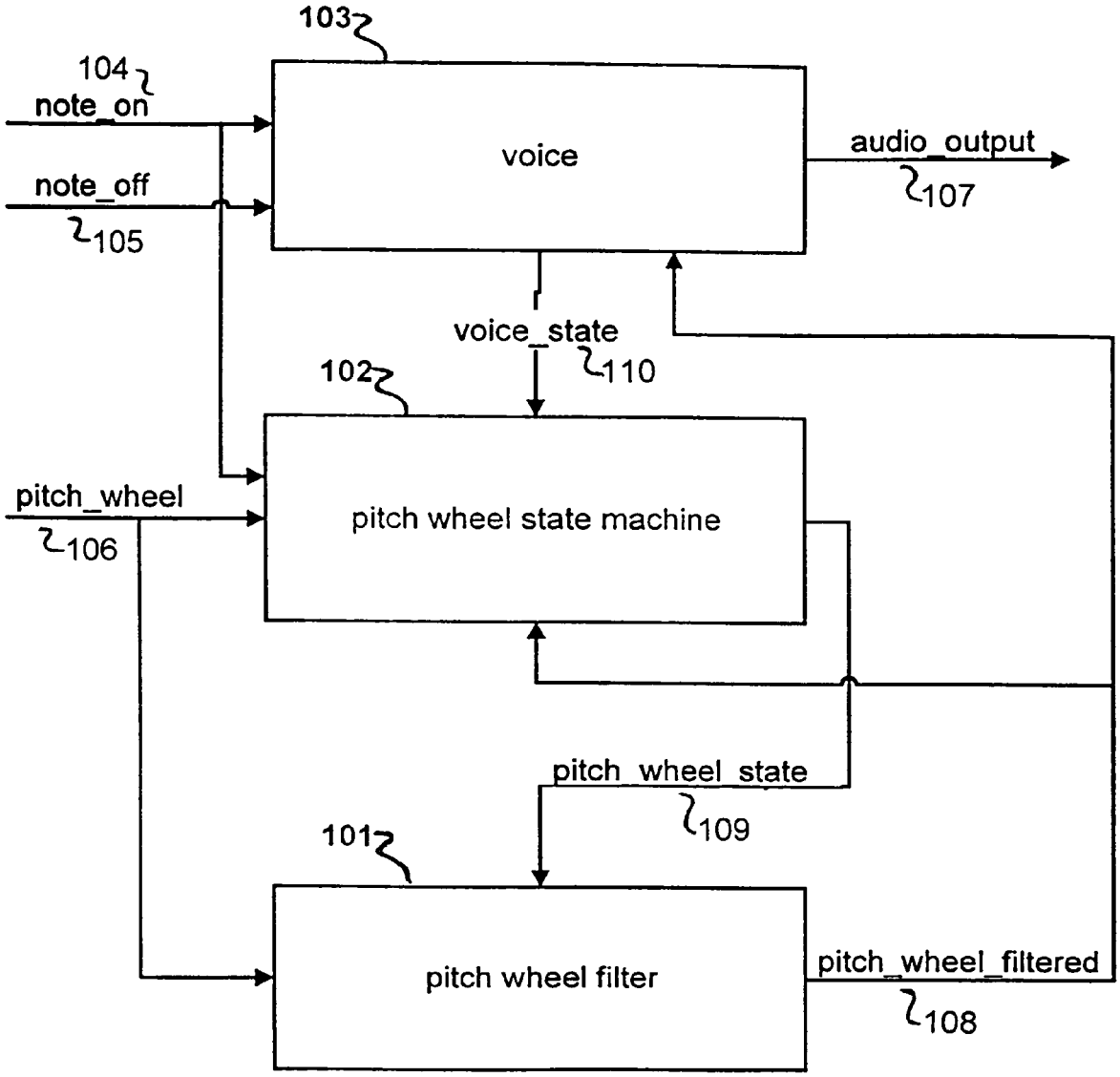
FIG. 10 shows an overall block diagram of one embodiment of the present invention.
Figure 11:
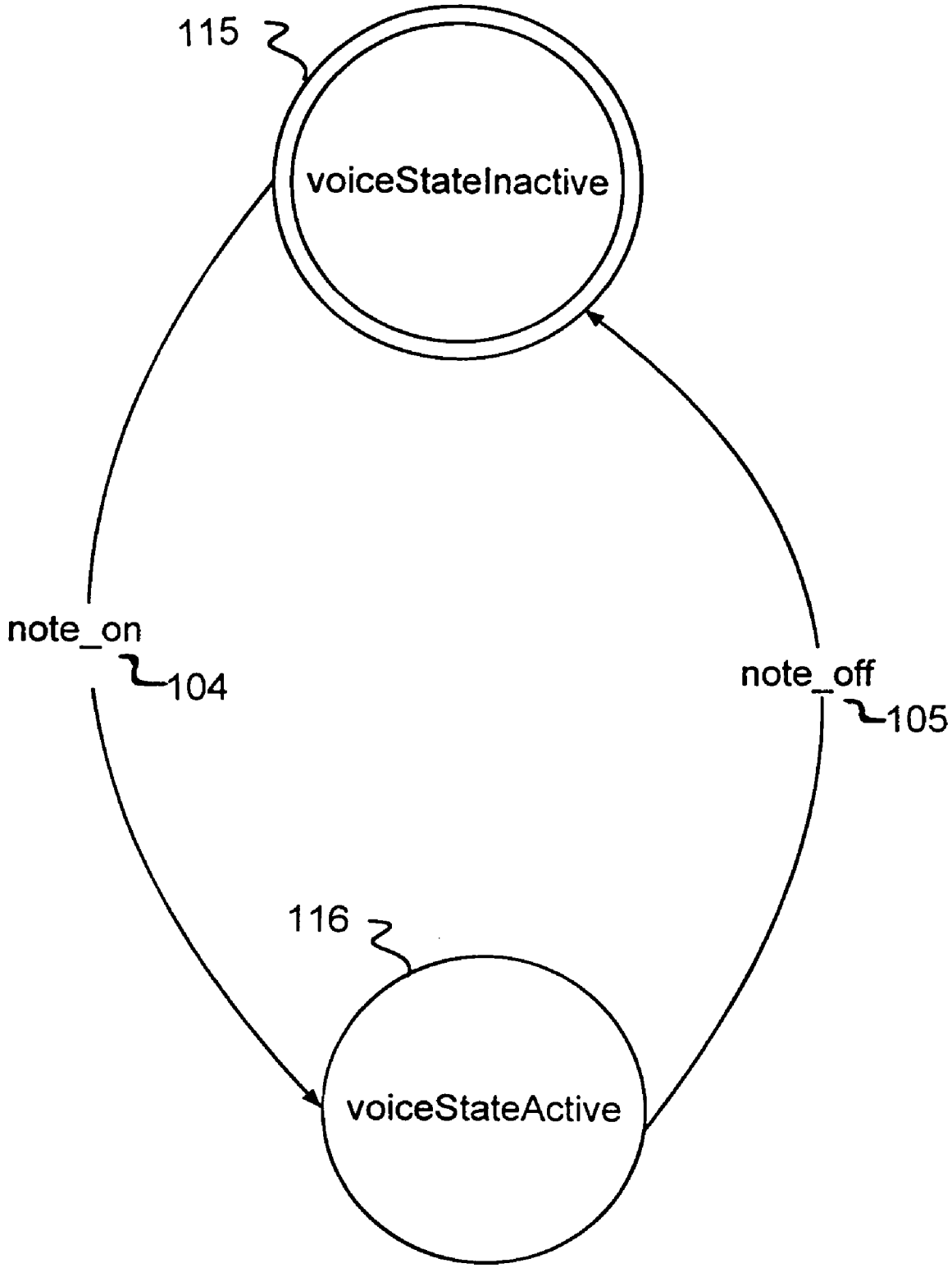
FIG. 11 shows the basic voice state machine of one embodiment of the present invention.
Figure 12:
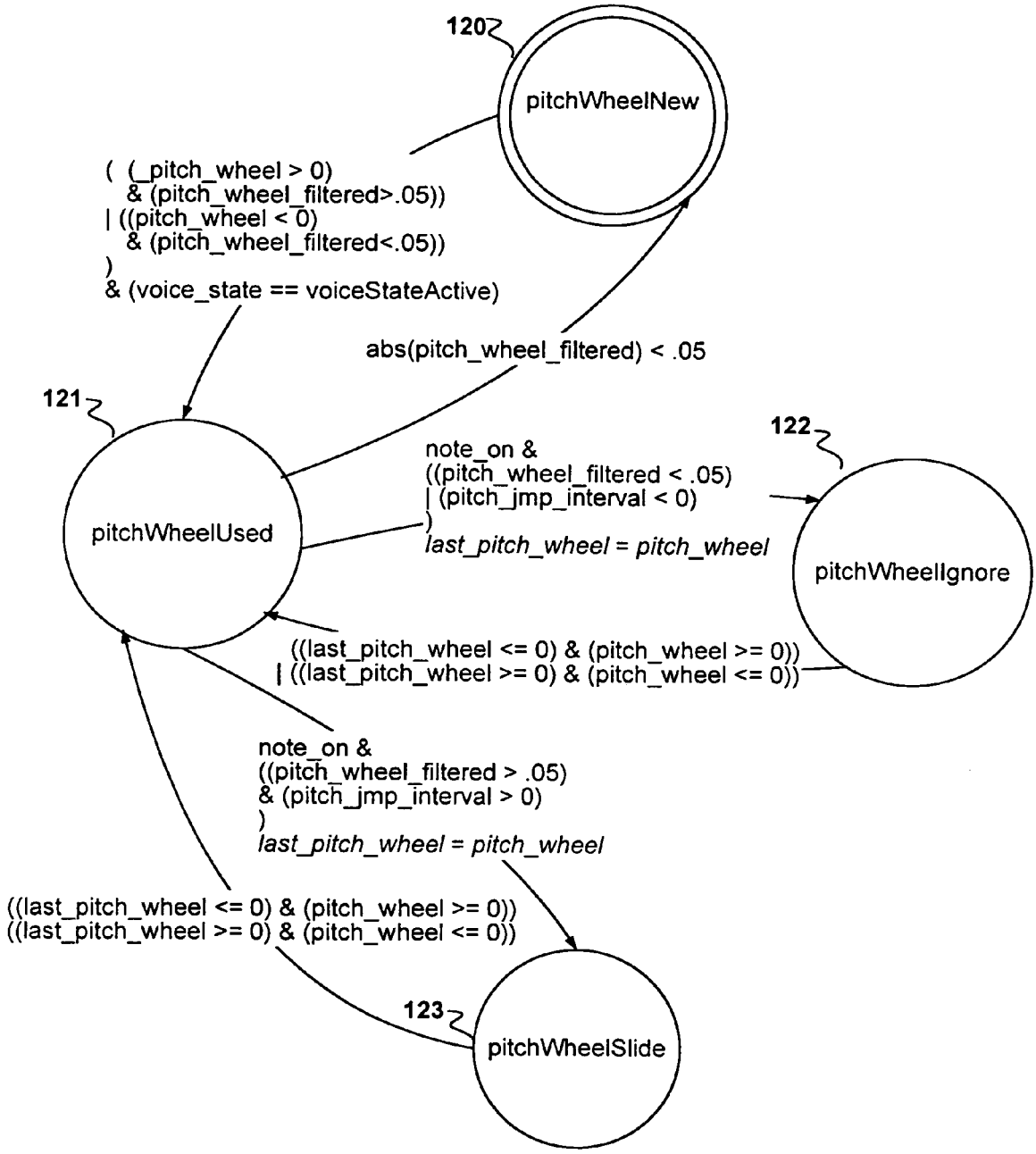
FIG. 12 shows the pitch wheel state machine of one embodiment of the present invention.

FIG. 10 shows a block diagram of a musical synthesizer according to an embodiment of the present invention. The pitch wheel signal 106 comes from a standard synthesizer controller such as a MIDI controller keyboard (not shown) and enters the pitch wheel filter 101 and the pitch wheel state machine 102 (FIG. 12 shows state machine 102 in more detail). The main function of the pitch wheel filter is to delay the pitch_wheel signal 106 about 0.50-0.100 seconds. The exact value of this delay is not critical. In this embodiment the pitch wheel filter is a two pole recursive filter. Since it is a pure smoothing filter with two coincident real poles, the two feedback coefficients a1 and a2 are given by:

$$a1=-2*\cos(R)a2=R2$$

where R=0.6 is the radius of the poles on the unit circle. The type and structure of this filter is not critical to the present invention as long as it generates approximately the delay required. The pitch_wheel_filtered signal 108 goes to the pitch wheel state machine 102 and the voice block 103 (FIG. 11 shows the operation of voice 103). The voice 103 generates the audio_output signal 107 as a function of note_on 104 and note_off 105 messages it receives from the synthesizer controller (not shown) and as a function of the pitch_wheel_filtered signal 108. The note_on messages 104 are accompanied by pitch and velocity parameters (not shown). In addition to the audio_output signal 107, the voice 110 generates a voice_state signal 110 reflective of its internal state which is input to the pitch wheel state machine 102.

FIG. 11 shows a basic state machine diagram of the internal operation of the voice 103. At the start the voice is in inactive state 115 waiting for a note_on message 104. When a note_on message 104 is received the voice goes to active state 116 and begins generating audio_output 107 until a note_off message 105 is received, at which point, after a brief decay of the audio_output, the voice returns to the inactive state 115.

FIG. 12 shows a state machine diagram of the internal operation of the pitch wheel state machine 102. At start up the state machine enters pitchBendNew 120 which is effectively an idle state. When a voice becomes active and both the raw_pitch_wheel and delayed_pitch_wheel filtered are non-zero with the same sign—indicating that the pitch_wheel is truly active—then state pitchBendUsed 121 is entered. In both states 120 and 121 the pitch wheel performs in the standard manner and the pitch wheel filter 110 continues to perform its delay function. If during state 121 the pitch_wheel_filtered returns to near zero the state returns to 120.

Figure 13:
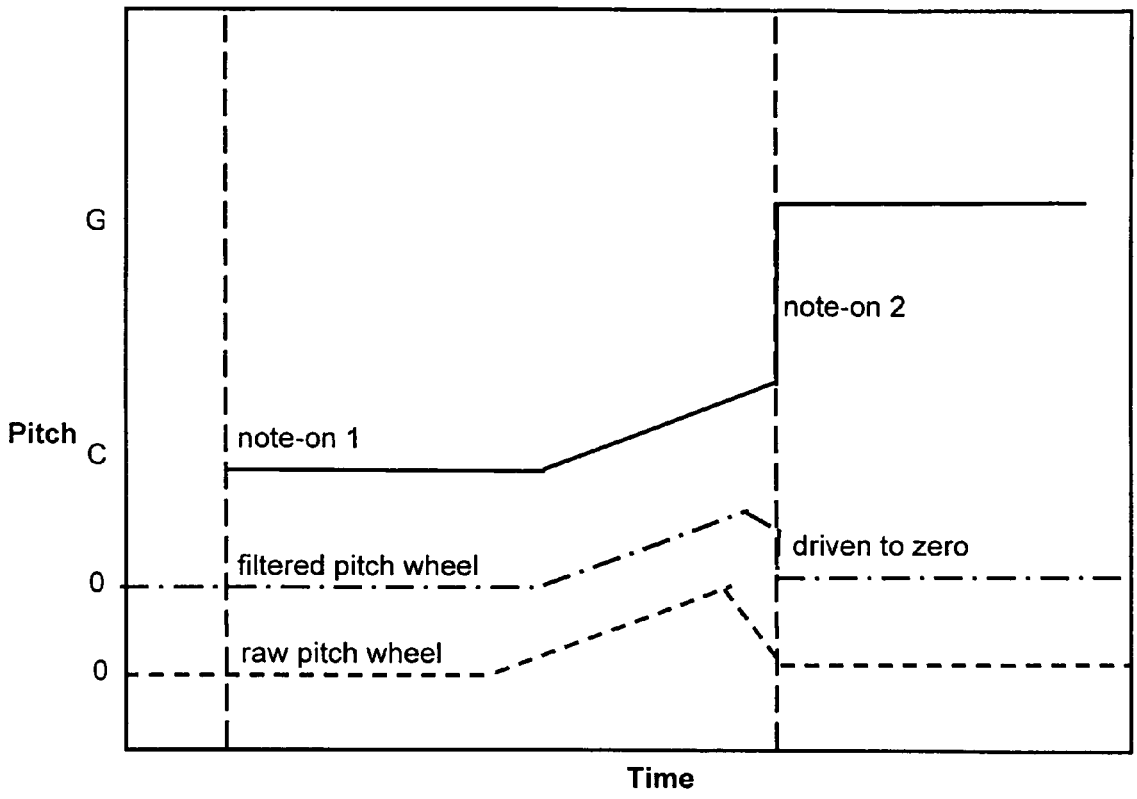
FIG. 13 shows the effect of delaying the pitch-wheel and driving it to zero to generate a slide-step pitch bend curve in accordance with one embodiment of the present invention.

If while in pitchBendUsed 121 a new note_on message is received and the current direction of the pitch_wheel is negative and the new note_on is a negative pitch interval relative to the current active voice pitch, then state pitchWheelIgnore 122 is entered. In 122 the pitch wheel filter 101 forces the pitch_wheel_filtered signal to zero effectively disabling the pitch wheel. This causes the desired slide-step pitch curve as shown in FIG. 13. While in 122 if the pitch wheel crosses or touches zero then the state returns to 121.

Figure 14:
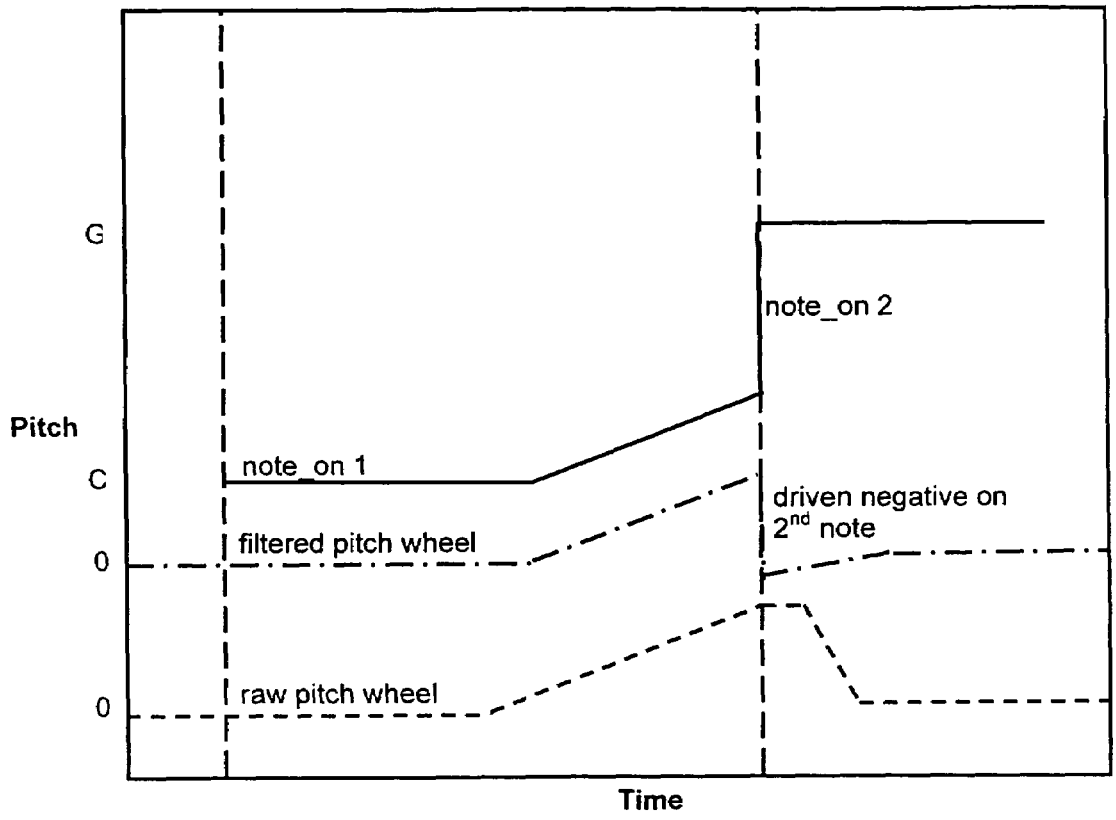
FIG. 14 shows the effect of delaying the pitch-wheel and driving negative on $2^{nd}$ note-on followed by ramp to zero to generate a slide-step-slide pitch bend curve in accordance with one embodiment of the present invention.

If while in pitchBendUsed 121 a new note_on message is received and the current direction of the pitch_wheel is positive and the new note_on is a positive pitch interval relative to the current active voice pitch, then state pitchWheelIgnore 123 is entered. In 123 the pitch wheel filter 101 driven slightly negative—e.g. one half step—and then is forced to ramp over approximately ⅓ second up to zero. This causes the desired slide-step-slide pitch curve as shown in FIG. 14. While in state 123 if the pitch wheel crosses or touches zero then the state returns to 121.

Those skilled in the art of sound synthesis will appreciate that the embodiments described herein are only examples illustrating the invention. The invention comprises apparatus and methods for responding to a pitch wheel control signal by generating synthesized portamento transitions that more nearly resemble portamento transitions from performed music.

The term "pitch wheel" is intended to indicate the source of a control signal (such as a MIDI signal) affecting pitch, and does not require that a conventional spring-loaded synthesizer pitch wheel be used to generate the signal. Any equivalent control device may generate the pitch wheel signal, including other physical interfaces such as sliders or switches, or computer generated control signals.

The present invention my be used with any sort of synthesizer, analog or digital, including traditional sampling synthesizers, LPC synthesizers, FM synthesizers, physical modeling synthesizers, and additive synthesizers.

What is claimed is:

1. A method for synthesizing a portamento transition between a first synthesized note and a second synthesized note, the second note beginning at substantially the same time as the end of the first note, based upon a pitch wheel control signal, the method comprising the steps of:

(a) modifying the pitch of a latter portion of the first note in proportionate response to the pitch control signal;

(b) modifying the pitch of an early portion of the second note in a different manner than in proportionate response to the pitch wheel control signal.

2. The method of claim 1, wherein step (b) is accomplished substantially without reference to the pitch wheel control signal.

3. The method of claim 2, further including the step of delaying the effect of the pitch wheel control signal by a selected amount.

4. The method of claim 3 wherein the step of delaying delays by about 0.05 to 0.1 seconds.

5. The method of claim 3 wherein the step of delaying includes the step of generating a delay using a two pole recursive filter.

6. The method of claim 3 wherein the delay causes a peak pitch wheel control signal value to be retained until the pitch wheel control signal approaches zero.

7. The method of claim 2, wherein step (b) further includes the step of applying a pitch ramp to an early portion of the second note.

8. The method of claim 2 wherein step (b) comprises the steps of:

(i) if the pitch wheel control signal is negative, ignoring the pitch wheel control signal; and (ii) if the pitch wheel control signal is positive, ignoring the pitch wheel control signal and applying a pitch ramp to an early portion of the second note.

9. A synthesizer of the kind which synthesizes a series of notes in response to an input note control signal and affects the pitch of portions of notes according to a pitch wheel control signal indicating pitch bend, the invention comprising:

means for synthesizing a first note at a first pitch and a second note at a second pitch, wherein the first note ends at approximately the same time the second note begins;

a mechanism for modifying the pitch of the latter portion of a first note responsive to the pitch wheel control signal; and a mechanism for disabling the response to the pitch wheel control signal from the beginning of the second note until the pitch wheel control signal indicates substantially no pitch bend.

10. The synthesizer of claim 9, further comprising a mechanism for applying a small ramp in pitch to the early portion of the second note.

11. The synthesizer of claim 10, wherein the mechanism for applying a small ramp in pitch applies only if the pitch wheel control signal is positive.

12. The synthesizer of claim 9, further comprising a delay element for applying a delay to the pitch wheel control signal.

* * * * *

UNITED STATES PATENT AND TRADEMARK OFFICE

CERTIFICATE OF CORRECTION

PATENT NO. : 7,271,331 B2
APPLICATION NO. : 11/342781
DATED : September 18, 2007
INVENTOR(S) : Eric Lindemann It is certified that error appears in the above-identified patent and that said Letters Patent is hereby corrected as shown below:

Column 3, Line 39, delete “combined.So” and insert --combined, so--.

Column 3, Line 44, delete “combined.So” and insert --combined, so--.

Column 3, Line 50, delete “combined.So” and insert --combined, so--.

Column 4, Line 53, delete “a1=-2*cos(R)a2=R2” and insert

--a1 = - 2*cos(R) a2=$R^2$--.

Column 4, Line 67, delete “110 generates” and insert --101 generates--.

Column 5, Line 19, delete “110” and insert --101--.

Column 5, Line 59, delete “my” and insert --may--.

Signed and Sealed this

First Day of April, 2008

JON W. DUDAS
*Director of the United States Patent and Trademark Office*